US006186735B1

(12) United States Patent
Deyo et al.

(10) Patent No.: US 6,186,735 B1
(45) Date of Patent: Feb. 13, 2001

(54) LOADER BUCKET CONSTRUCTION FOR ROBOT ASSEMBLY

(75) Inventors: Charles E. Deyo, Lisbon; Daniel T. Antrim, Mooreton; Jonathan C. Hollingsworth, Oakes; Patrick K. Kuhn, Bismark; Deborah N. Walock, Enderlin; Kenneth R. Weber, Milnor; James W. Wolsky, Gwinner, all of ND (US)

(73) Assignee: Clark Equipment Company, Woodcliff Lake, NJ (US)

( * ) Notice: Under 35 U.S.C. 154(b), the term of this patent shall be extended for 0 days.

(21) Appl. No.: 09/255,176

(22) Filed: Feb. 22, 1999

Related U.S. Application Data

(60) Provisional application No. 60/104,183, filed on Oct. 14, 1998.

(51) Int. Cl.[7] ..... B65D 6/00

(52) U.S. Cl. ..... 414/722; 29/466; 29/DIG. 48; 37/264; 37/398; 37/411

(58) Field of Search ..... 414/722; 37/264, 37/398, 411, 450, 451, 452; 29/428, 464, 466, 469, 897, 897.2, 897.3, DIG. 48; 228/135, 182

(56) References Cited

U.S. PATENT DOCUMENTS

| | | | |
|---|---|---|---|
| 3,093,917 | 6/1963 | Schroeder | 37/141 |
| 3,831,690 | 8/1974 | Yamaoka et al. | 180/6.66 |
| 4,123,861 | 11/1978 | Hemphill | 37/195 |
| 4,523,397 | 6/1985 | Lucas | 37/118 R |
| 4,799,852 | 1/1989 | Ramun | 414/724 |
| 5,901,480 | 5/1999 | Shamblin | 37/444 |

FOREIGN PATENT DOCUMENTS

| | | |
|---|---|---|
| 295 16 969 | 12/1995 | (DE) . |
| 2 593 204 | 7/1987 | (FR) . |
| WO 86/04625 | 8/1986 | (WO) . |

OTHER PUBLICATIONS

"Specialized Buckets For Specialized Jobs" brochure No. Kn–20M–1291–#5022–F, by Melroe Company, published Dec., 1991.

Drawings showing buckets in public use at least as early as 1991. Exhibits 1, 2 and 3.

*Primary Examiner*—Donald W. Underwood
(74) *Attorney, Agent, or Firm*—Westman, Champlin & Kelly, P.A.

(57) ABSTRACT

A bucket for a front end loader is formed with a minimum number of parts so that it can easily be assembled held in fixtures and welded with robot welders. The bucket includes a unitary panel that forms a bottom wall and a rear wall, with a curved junction wall between the bottom and rear walls. An integral top rail is formed at the upper edge of the rear wall for structural integrity. The formed top rail is made with a sloped top rail wall to increase the visibility of a load in the bucket to an operator in a cab of a skid steer loader. The bucket walls and parts which weld thereon have locating tabs and mating edges for locating the parts automatically, so that they can be welded into position. The bucket is made with brackets for mounting it onto a quick attachment plate of a skid steer loader.

16 Claims, 12 Drawing Sheets

LOADER BUCKET CONSTRUCTION FOR ROBOT ASSEMBLY

CROSS REFERENCE TO RELATED APPLICATION

This application claims priority on prior copending United States provisional application Ser. No. 60/104,183, filed Oct. 14, 1998.

BACKGROUND OF THE INVENTION

The present invention relates to a bucket construction for a bucket of a front end loader, which is made in a manner that permits automated or robot assembly and final welding of the parts and subassemblies.

Prior art buckets for front end loaders are generally welded assemblies, which require a large amount of hand welding and assembly, and thus the cost is increased. In many instances the bucket parts and subassemblies are assembled in a manner so that a robot controlled welding head cannot access the desired weld line.

The prior art buckets also are made of many individual pieces that require welds for assembly. Thus reducing the number of parts is desirable.

SUMMARY OF THE INVENTION

The present invention is a bucket for a front end loader that is simplified in construction so that the parts can be handled with robots and tack welded in place. The robots used can hold the critical dimensions of brackets used for the attachment of the bucket to a loader through a quick attach adapter.

The number of parts and subassemblies used in the final assembly and welding of the bucket is reduced in part by forming a bucket panel that forms the bottom wall and the rear wall in one piece joined by a curved junction portion. The reinforcing and attachment top rail at the top of the rear wall is formed as a single folded box cross section. After folding or forming the rail requires only an external weld that can be made with a robot welding head. The top rail is made so that it tapers down in a forward direction to increase the visibility of a load to an operator in the cab of a skid steer loader having a bucket made according to the present invention.

The bucket walls and parts have locating tabs formed to provide reference edges that are engaged by edges on the part to be located. Outer edges of the parts are used, as well as edges of slots formed for the express purpose of alignment. The parts that need to be manipulated are provided with robot grip attachment holes so the same robot can be used for many different types of buckets.

DETAILED DESCRIPTION OF THE PREFERRED EMBODIMENTS

Figure 1:
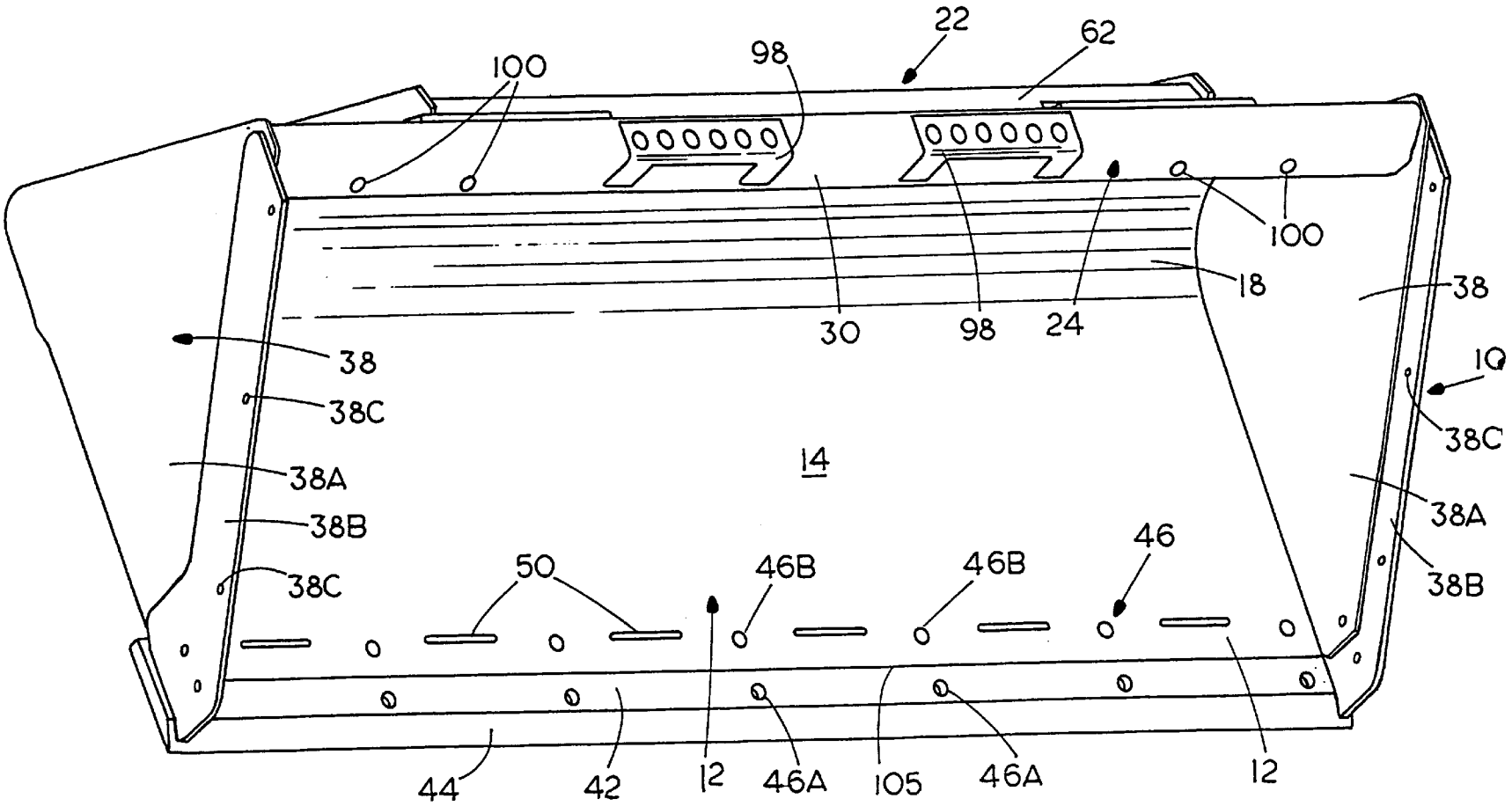
FIG. 1 is a top front perspective view of the bucket of the present invention.
Figure 2:
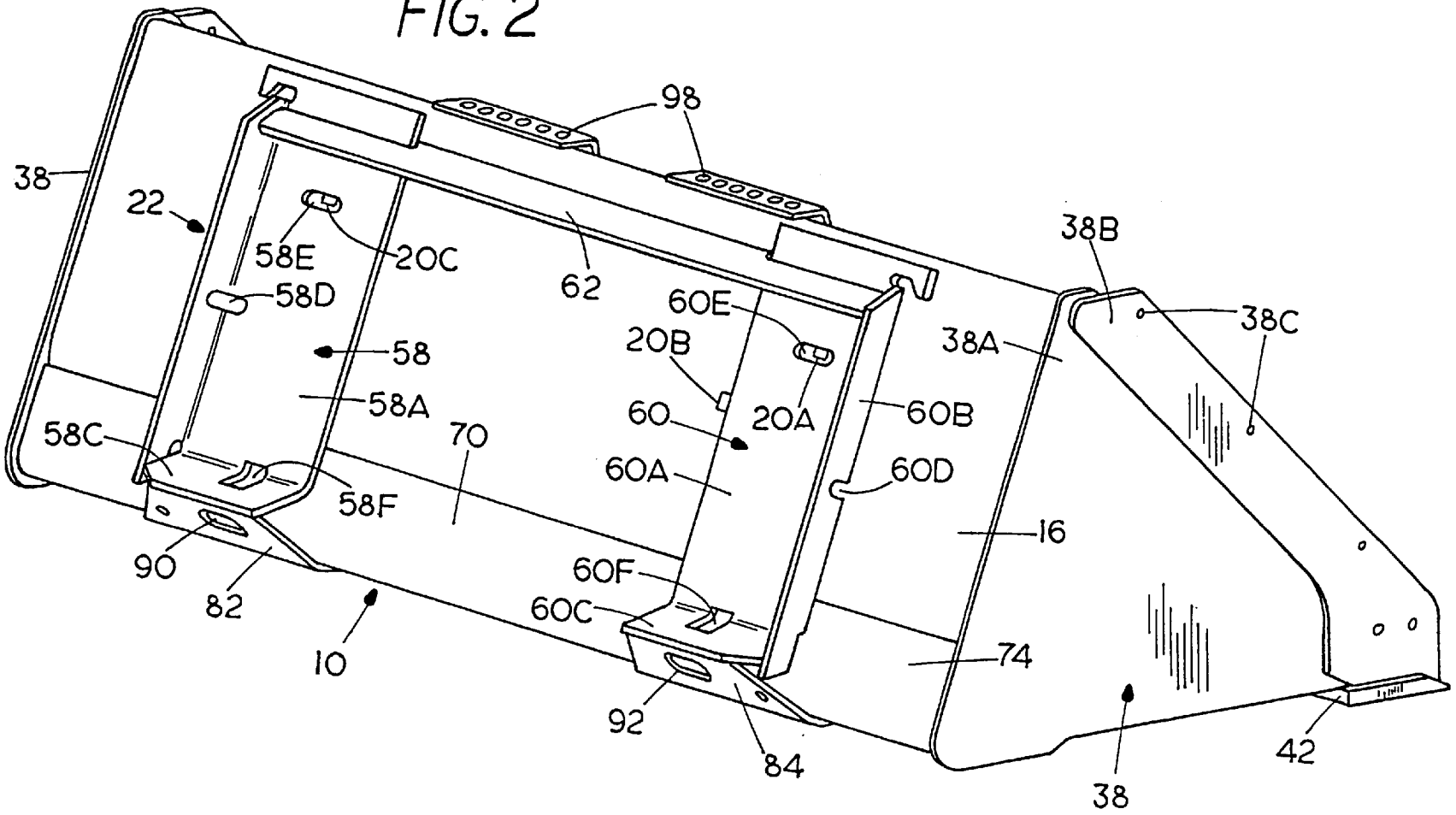
FIG. 2 is a rear perspective view of the bucket of FIG. 1.

A bucket 10 is shown assembled in FIGS. 1 and 2 and is made with a minimum number parts and subassemblies and is manufactured by robot methods. The bucket 10 has a main single sheet wrap around panel 12 that forms a bottom panel or wall 14 and an upright rear wall 16, that joins the bottom wall in a curved junction wall 18. The rear wall 16 has a plurality of formed tabs 20A, 20B and 20C, (FIG. 2) that are used for locating parts to be attached to the wrap around panel. The tabs 20A, 20B and 20C are used for locating an attachment adapter 22 that is a welded mounting bracket subassembly at the time of final welding and assembly of the bucket.

Figure 12:
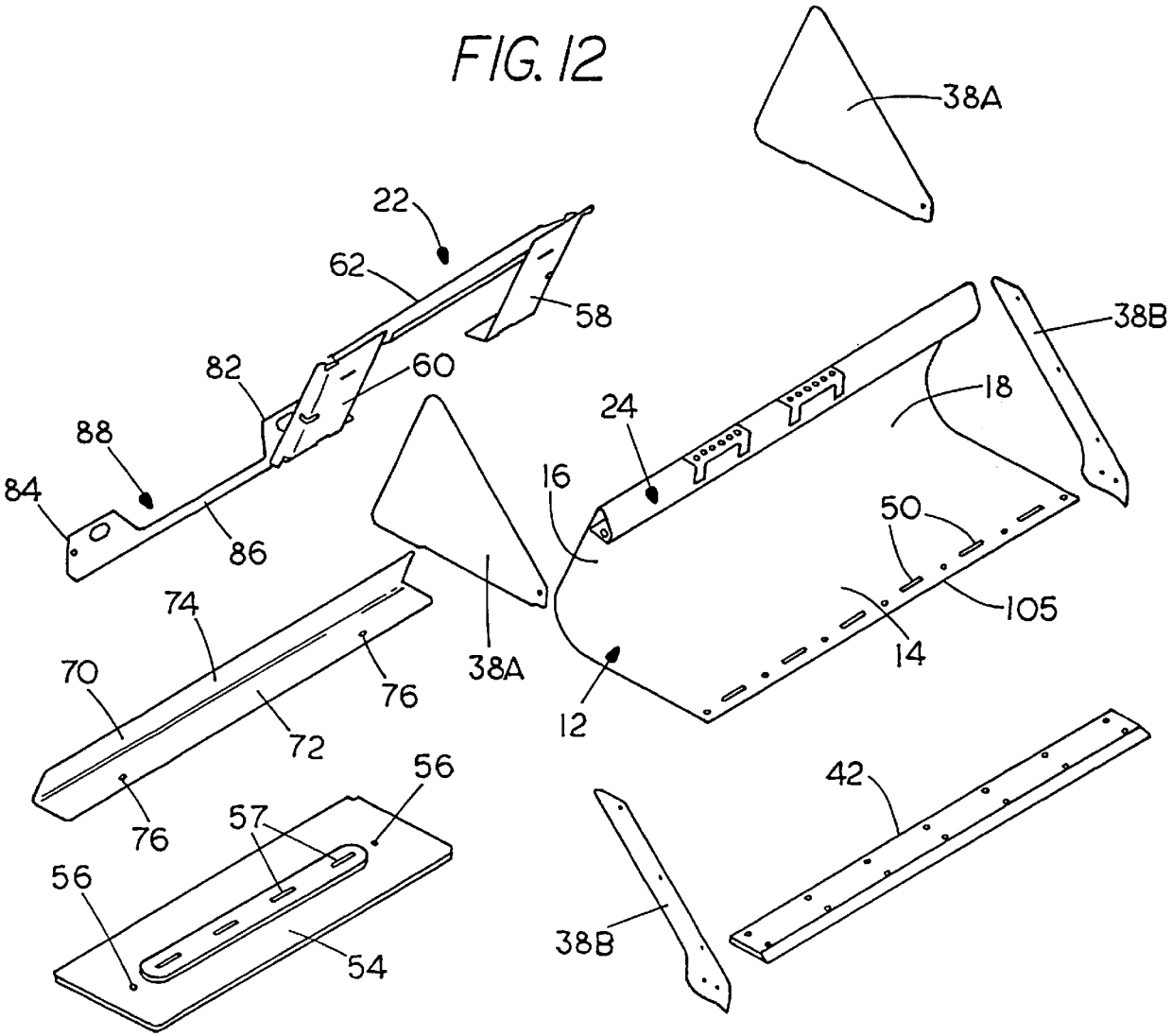
FIG. 12 is an exploded view of the parts assembled by robots during the final welding stage.

FIG. 12 is an exploded view of the bucket showing the parts that are used in the final welding process. Reference can be made to the Figures as the description proceeds.

Figure 8:
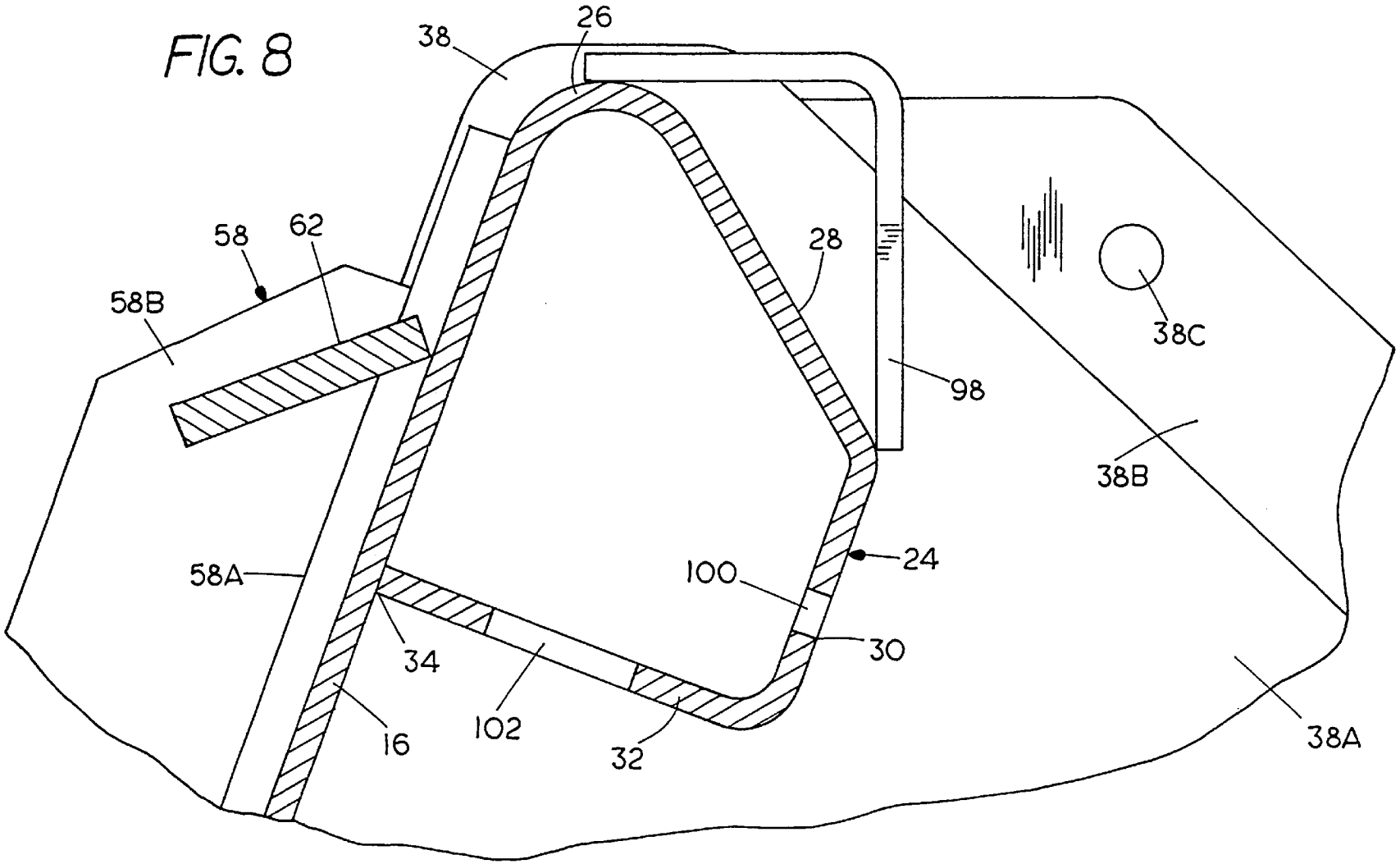
FIG. 8 is an enlarged sectional view of a top rail of the bucket of FIG. 1.

The rear or back wall 16 of the bucket formed by the wrap around panel 12 inclines forwardly from the curved junction wall 18 and terminates in a formed box section top rail 24. The top rail 24 can be rolled from the wrap around panel 12 and as best shown in FIG. 8, includes a top curved edge 26 that joins a downwardly and forwardly inclined wall 28 that tapers forwardly at a slope that is designed to increase the ability of an operator on a skid steer loader to see into the interior of the bucket when working. The top rail 24 has a forward wall 30 that is parallel to the rear wall 16. The forward wall joins a bottom wall 32 that has an edge the engages or is very close to the front or inner surface of the rear wall 16. In the final welding process, the junction line or seam 34 forming the edge of the bottom wall 32 that engages the front surface of rear wall 16 is welded to rear wall 16 with a welding head operated by a robot. The welding junction line along the edge of the bottom wall is open from below and can be reached by a robot welding head. The weld can extend all the way across the width of the bucket.

Figure 7:
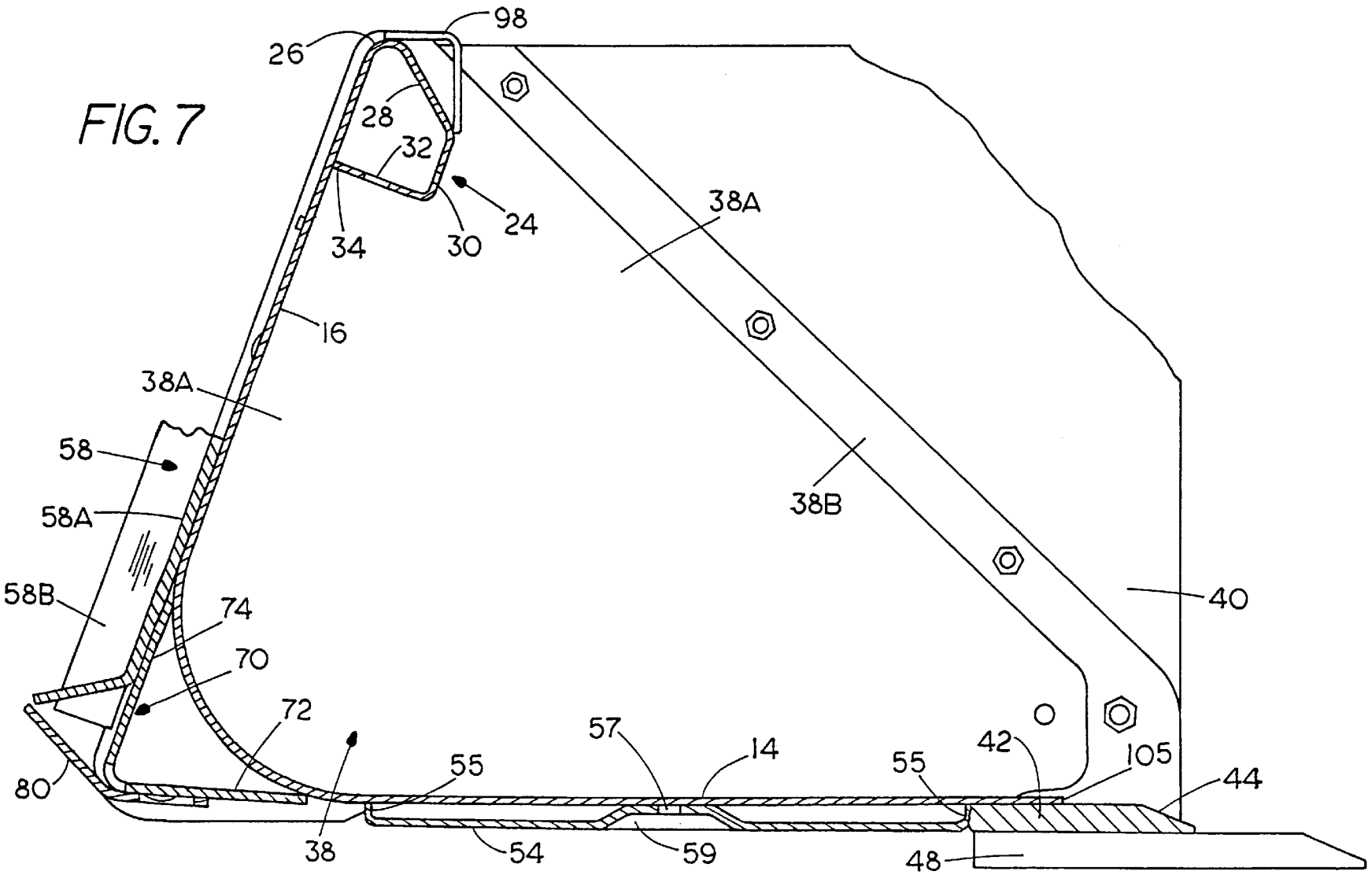
FIG. 7 is a sectional view taken on line 7—7 in FIG. 3.

The bucket wrap around panel or sheet 12 has end plates 38 welded at opposite ends thereof, and the end plates each include the main panel 38A and the top support panel 38B, that has a series of holes 38C that are used for attaching wear plates or extensions panels 40 shown in FIG. 7. The extension panels are used where less dense material is carried, although the main panels and top support panels, which are welded together, will hold the rated capacity of the loader on which the bucket is intended to be used. The auxiliary or extension panels 40 are optional. The end plates 38, each including a main panel 38A and a top panel 38B are tacked or tack welded as a subassembly prior to the final assembly welding of the parts shown in FIG. 12.

The wrap around panel 12 is the main structural component of the bucket and is used for mounting the rest of the components, including a bar 42 forming a cutting edge which extends all along and under the front edge of the bottom wall 14 of the bucket, which is part of the wrap around panel 12. The cutter bar 42 has a tapered or sharpened leading edge 44 that extends forwardly of the bottom wall of the bucket. A series of holes 46 that are arranged in fore and aft extending pairs 46A and 46B and are used for bolting on teeth shown schematically at 48 in FIG. 7 after the welded assembly is made. The teeth are optional as well and in many applications the cutting edge is used without teeth, particularly when loading or handling loose material. The teeth 48 are used primarily for digging.

The wrap around panel 12 is held in a robot fixture and can be manipulated to invert it as needed. The top rail is formed before any assembly so the curved panel 12 with the formed top rail is shown in FIG. 12 before parts are welded to it.

Figure 3:
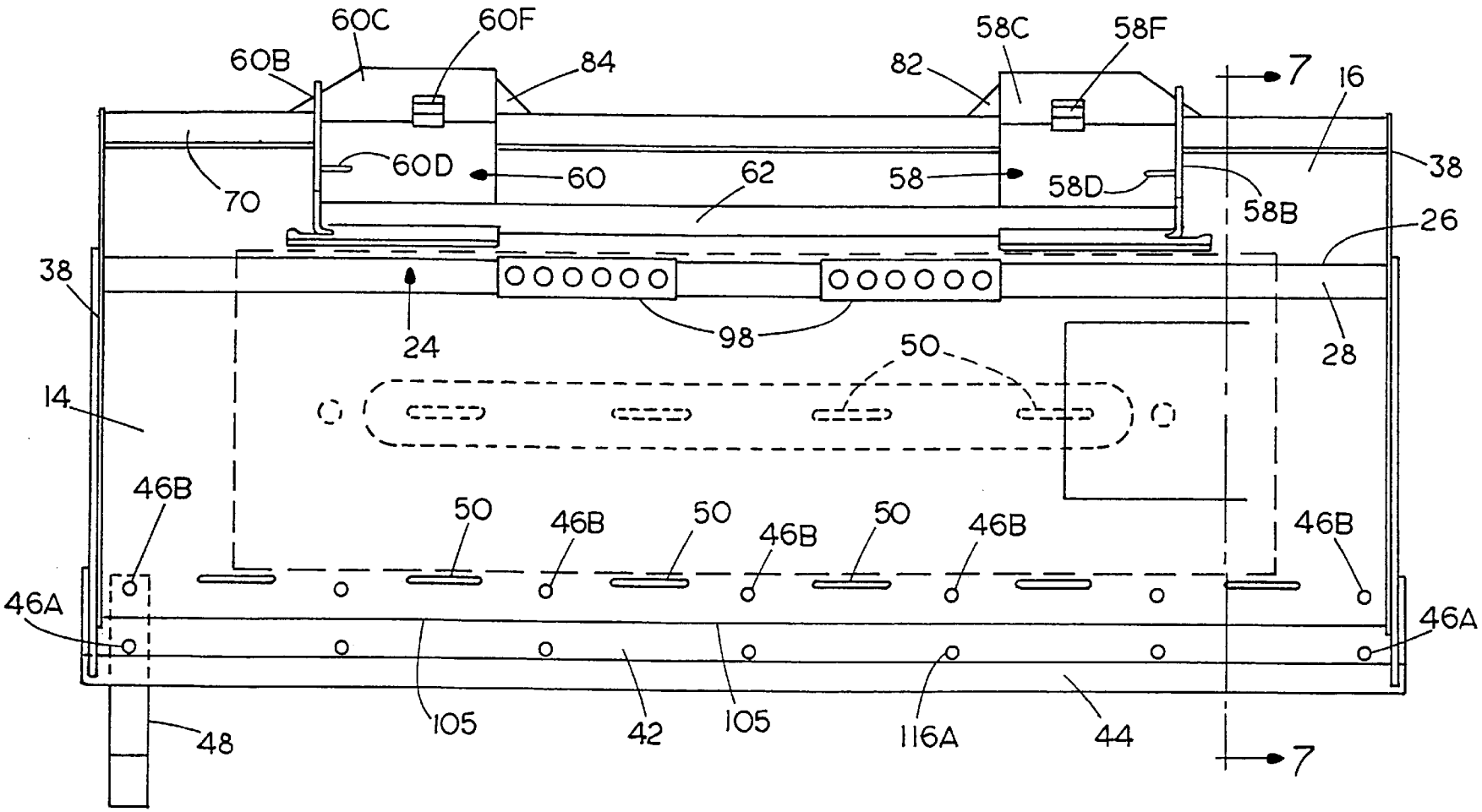
FIG. 3 is a top plan view of the bucket of FIG. 1.

The cutter bar 42 is tack welded in place in a first tack welding station after aligning the parts using the holes 46B which aligned with holes 46B in the bottom wall 14 (see FIG. 3). The bottom wall 14 also has a series of slots 50 formed therethrough which overlie the rear portion of the cutter bar 42. These slots 50 are used for welding the cutter bar to the bottom wall 14. This welding at the slots 50 can be a tack weld in initial assembly and full welding can be during final assembly welding of the bucket. The wrap-around panel is held in a robot fixture in a conventional manner as the parts are added to it during the final welding and assembly process.

The bottom wall or panel 14 is reinforced using a skid or wear plate 54 that is provided with spaced holes 56 (see FIG. 9) that are spaced for connection to robot grips that pilot into the holes and securely grip the plate 54. The robot then places the plate 54 on the bottom wall and the plate 54 is tack welded to the bottom wall through slots 57.

The mounting bracket subassembly 22 is mounted on the rear side of the bucket and used with a quick attachment plate on a loader such as a skid steer loader made by Melroe Company of Fargo, N.Dak., and sold under the mark "Bobtach". Such a quick attachment plate is disclosed in U.S. Pat. No. 3,672,521. The mounting brackets 58 and 60 are initially assembled together with an attachment lip 62 to form the subassembly 22, and then the mounting brackets in the subassembly are located in portion and tack welded on the back or rear wall 16 of the wrap around panel. This is done right after the cutter bar is tack welded to the bottom wall 14.

The brackets 58 and 60 are right and left hand and each has a flat plate portion 58A and 60A and bent up legs 58B and 60B on the outer sides. Additionally, the brackets have outwardly bent bottom flanges 58C and 60C, respectively. The subassembly is properly located using a robot for holding the subassembly and placing it onto the exterior of the back wall of the wrap around panel. The plate portions 58A, 60A have slots 58D and 60D that are formed before the legs 58B and 60B are bent up so there are slot sections in both the flat plate portions and the legs after the legs are bent. The slots 58D and 60D form holes for grippers of the robots used to hold the mounting bracket subassembly 22 for moving it toward and into contact with the outside of the rear wall. The brackets 58 and 60 also have positioning or locator slots 58E and 60E formed in the plate portions that have upper edges positioned to provide a reference locator line. The locator slots 58E and 60E are used for locating the subassembly 22 vertically on the top edges of locator tabs 20A and 20C for tack welding. Both mounting brackets 58B and 60B have the slots 58E and 60E so the same punched blank can be used for both brackets, and the right and left forms made by bending the legs 58B and 60B and the bottom flanges 58C and 60C in opposite directions.

Figure 10:
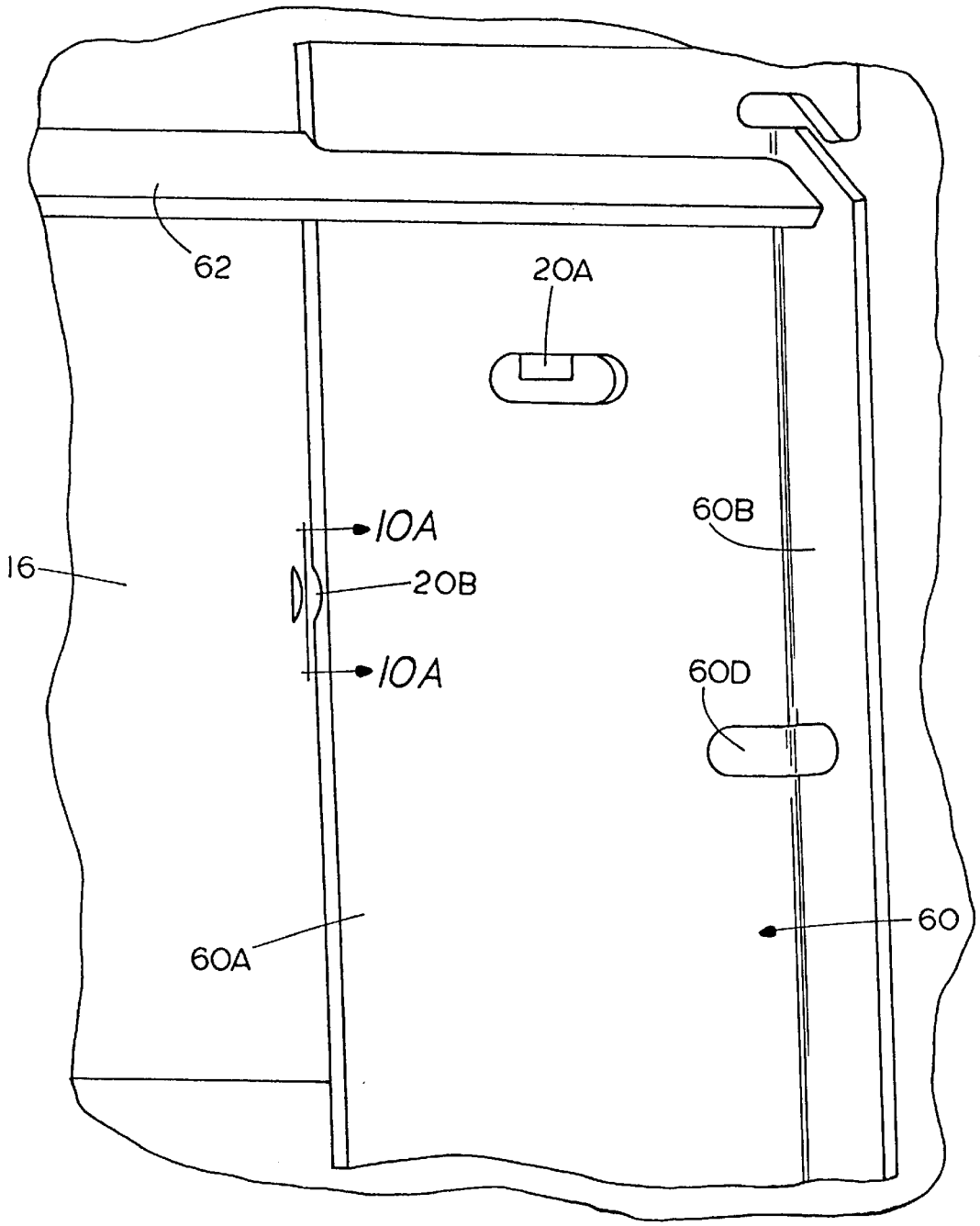
FIG. 10 is a fragmentary rear view of a mounting bracket subassembly on a rear wall of the bucket showing locating tabs and edges for locating mounting bracket parts for robot assembly.
Figure 10A:
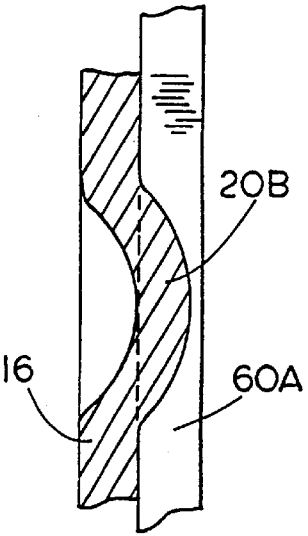
FIG. 10A is an enlarged sectional view taken on line 10A—10A in FIG. 10.

The rear or back wall 16 of the bucket has the three locator tabs 20A, 20B and 20C partially punched out, as explained. The tab 20A is positioned to fit into the slot 60E, and the tab 20C is positioned to fit in the slot 58E for vertical positioning of the bracket subassembly, and the tab 20B is used to locate the upright or vertical edge of one of the brackets, as shown bracket 60. The three point positioning positively locates the bracket properly. The tabs 20A, 20B and 20C are formed as shown in FIG. 10A and each partial punch out is made to have a substantially straight, flat edge that engages the surface to be located, so the positioning is accurate.

The subassembly 22 then can be tack welded in position, at desired locations, while being held by the robot properly positioned by the alignment tabs 20A, 20B and 20C.

The flanges 58C and 60C have slots 58F and 6OF that are used for lock pins that are on the attachment plate used on the loader. Before final tack welding in place, these slots 58F and 60F are used to fit into a jig or fixture so that they are properly spaced and then the bracket subassembly 22 is tack welded in place.

The wrap around panel then is inserted and a corner bracket reinforcement or back brace is then placed into position and is best seen in FIG. 7. Reinforcement angle or back brace 70 is an angle shaped formed piece of metal indicated generally at 70 which has a leg 74 that extends up under the lower portions of the brackets 58 and 60 to brace the ends and reinforce them. The reinforcement is moved up between the rounded corner portion 18, and the ends of the brackets 58 and 60. The lower leg 72 of the reinforcement 70 is positioned to engage the rounded corner 18 near its junction with the bottom wall 14, as shown in FIG. 7 in particular, and is tack welded in place. The bracket 58 is shown partially broken away and in section in FIG. 7.

Figure 9:
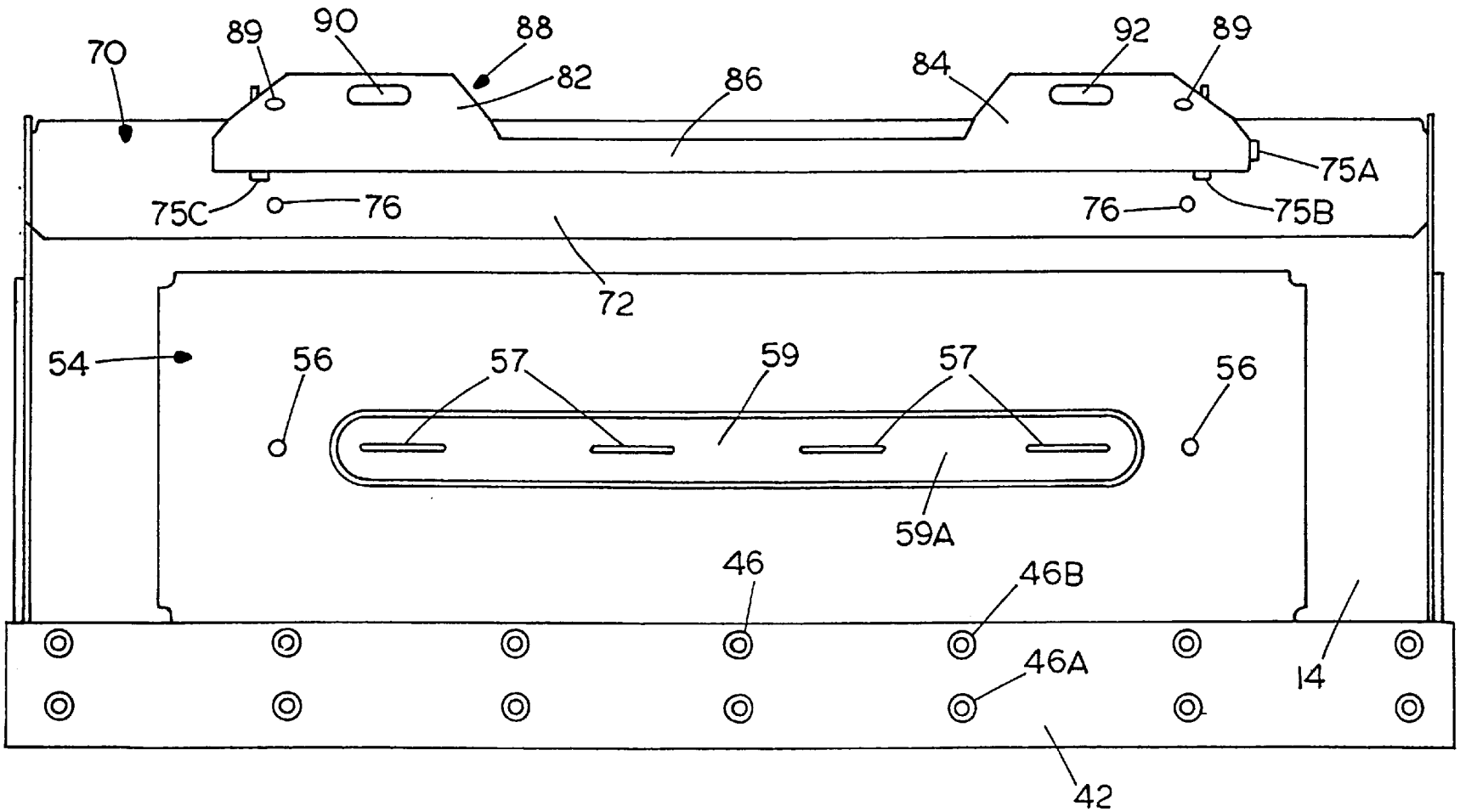
FIG. 9 is a bottom plan view of the bucket of FIG. 1.
Figure 11:
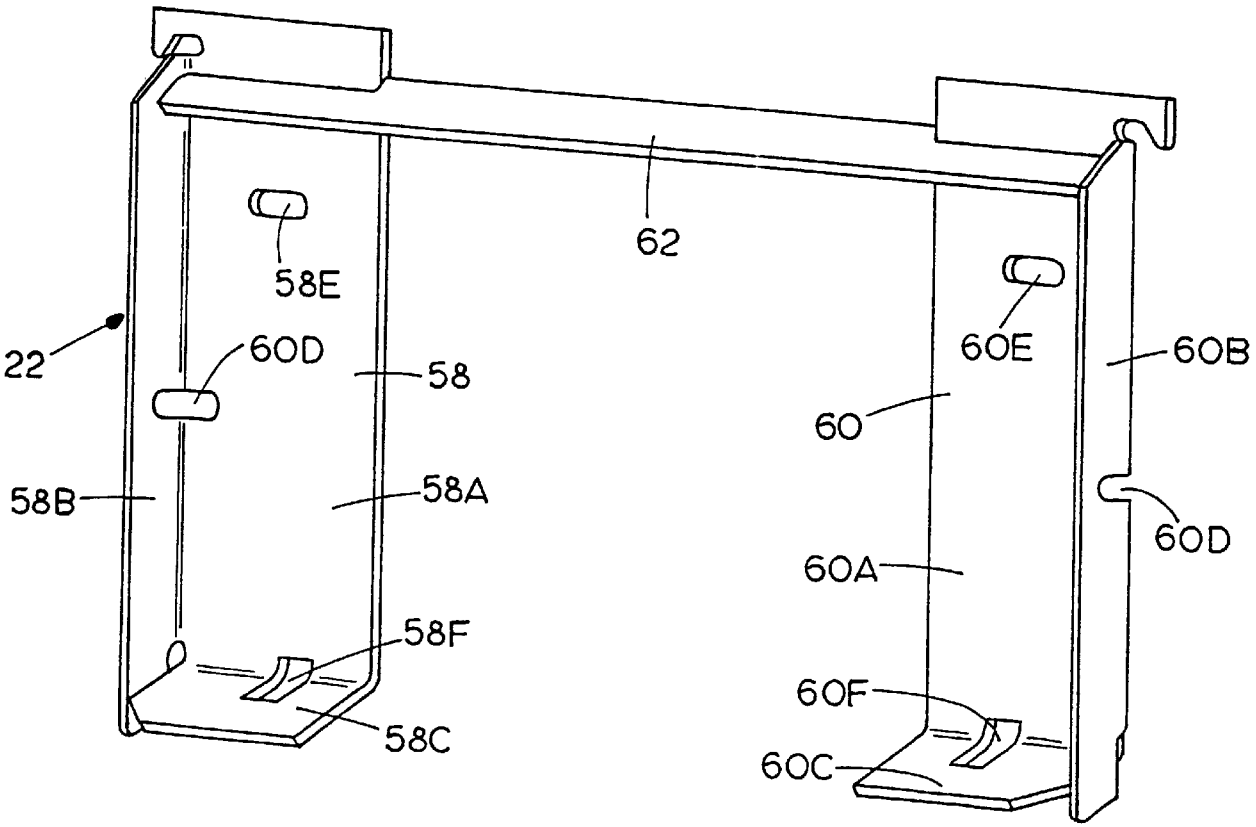
FIG. 11 is a perspective view of a bucket adapter mounting bracket subassembly to show details of the mounting bracket.

The lower leg 72 of the reinforcement 70, as can be seen in FIG. 9, has a pair of robot gripper holes 76, 76 which are spaced apart the same distance as holes 56, 56 of the reinforcing plate or wear plate 54.

In addition, the lower leg 72 of the reinforcement member 70 has three alignment or locator tabs 75A, 75B and 75C formed thereon. These locator tabs 75A, 75B and 75C are formed in the same manner as that shown in FIG. 10A, and project out from the lower portion of the leg 72 of the reinforcement member 70. The reinforcement member 70 is tack welded in place after the leg 74 is urged up between the lower ends of brackets 58 and 60 and the bucket rear wall and the edge of leg 72 rests on the lower side of the curved portion 18.

The attachment brackets 58 and 60, and in particular, the flanges 58C and 60C are mated with a lower latch plate assembly 80 that has flanges 82 and 84 on opposite ends thereof, and which are joined by a center member 86. The assembly of the two flanges 82, 84 and the member 86 is indicated at 88, and this assembly is located in position by the tabs 75A, 75B and 75C. Edges of flanges 84 are engaged by tabs 75A for end use locating 75B for fore and aft location. Tab 75C locates flange 82 in fore and aft direction. It can also be seen that the flange assembly has robot gripper openings 89, 89 on the outer edge portions of the flanges 82 and 84, and these are again spaced the same distance apart as the robot gripper opening 76, 76 so the same robot can be used for placing the latch assembly 88 into position against the locator tab 75A, 75B and 75C.

Again there are three of the locator tabs for the assembly 88, so that the assembly can be positively positioned against these tabs while held by a robot gripper, and will be properly located so that latch openings 90 and 92 will be aligned with the slots 58F and 60F, so when lock members (not shown) from the quick attachment plate of a skid steer loader, such as that shown in U.S. Pat. No. 3,672,521, which is incorporated herein by reference, are placed into position. The lock member of the attachment plate slots 58F and 60F, and into the latch openings 90 and 92, respectively on the flanges 82 and 84.

This action will positively latch the bucket in place on the attachment plate, once the final assembly welding is done, and securely hold the bucket for working relative to the skid steer loader. The placing of the corner reinforcement 70, and the assembly 88 onto the wrap around panel, at the rounded corner 18, is done after the bucket has been inverted, and that is when the plate 54 is also installed.

Figure 5:
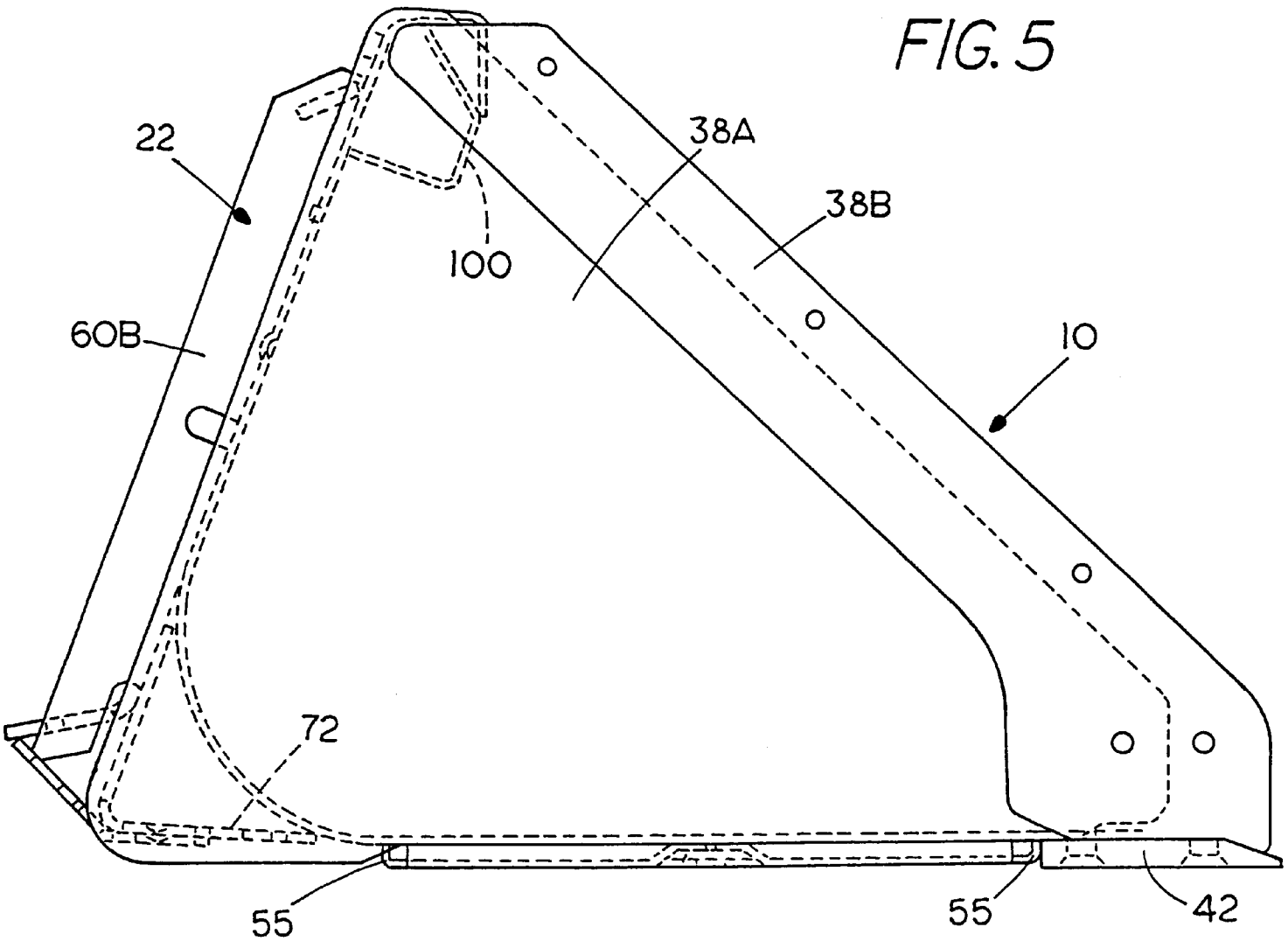
FIG. 5 is a side elevational view of the right side of the bucket of FIG. 1.

As can be seen, the plate 54 is a formed plate, so that the slots 57, 57 are in a channel 59 that is formed in the center portions of the plate 54. A channel wall 59A of the formed channel will engage the under surface of the bottom wall 14, for welding. The edges of the panel or wear plate 54 can be formed, as shown by the wall portion 55, in FIG. 5, to engage the underside of the bottom wall 14 and the flanges are welded to the bottom wall.

Then, the end plates 38 can be placed onto the ends of the wrap around panel to form the bucket. The end plates can be held with suitable suction cups or the like with robots, and placed against the end edges of the wrap around panel, and tack welded in place around the top rail and along the junction with the top rail.

Figure 4:
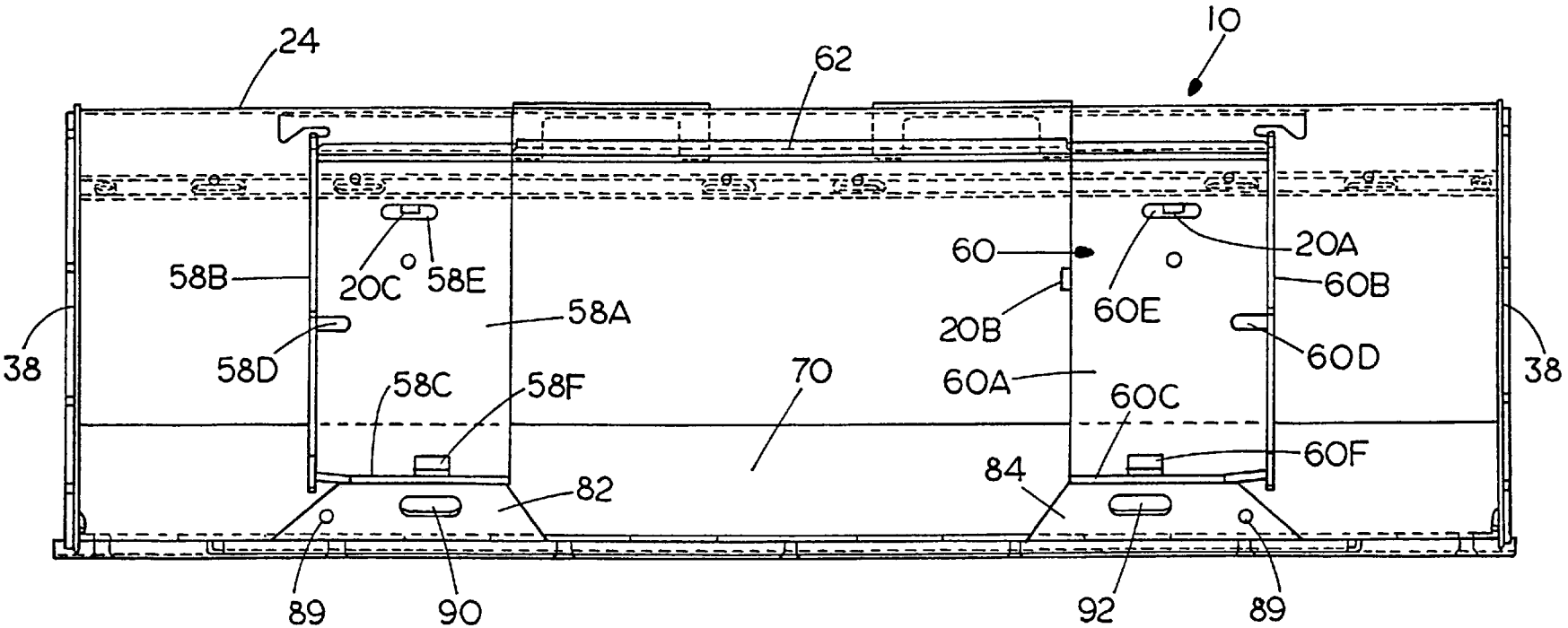
FIG. 4 is a rear elevational view of the bucket of FIG. 1.
Figure 6:
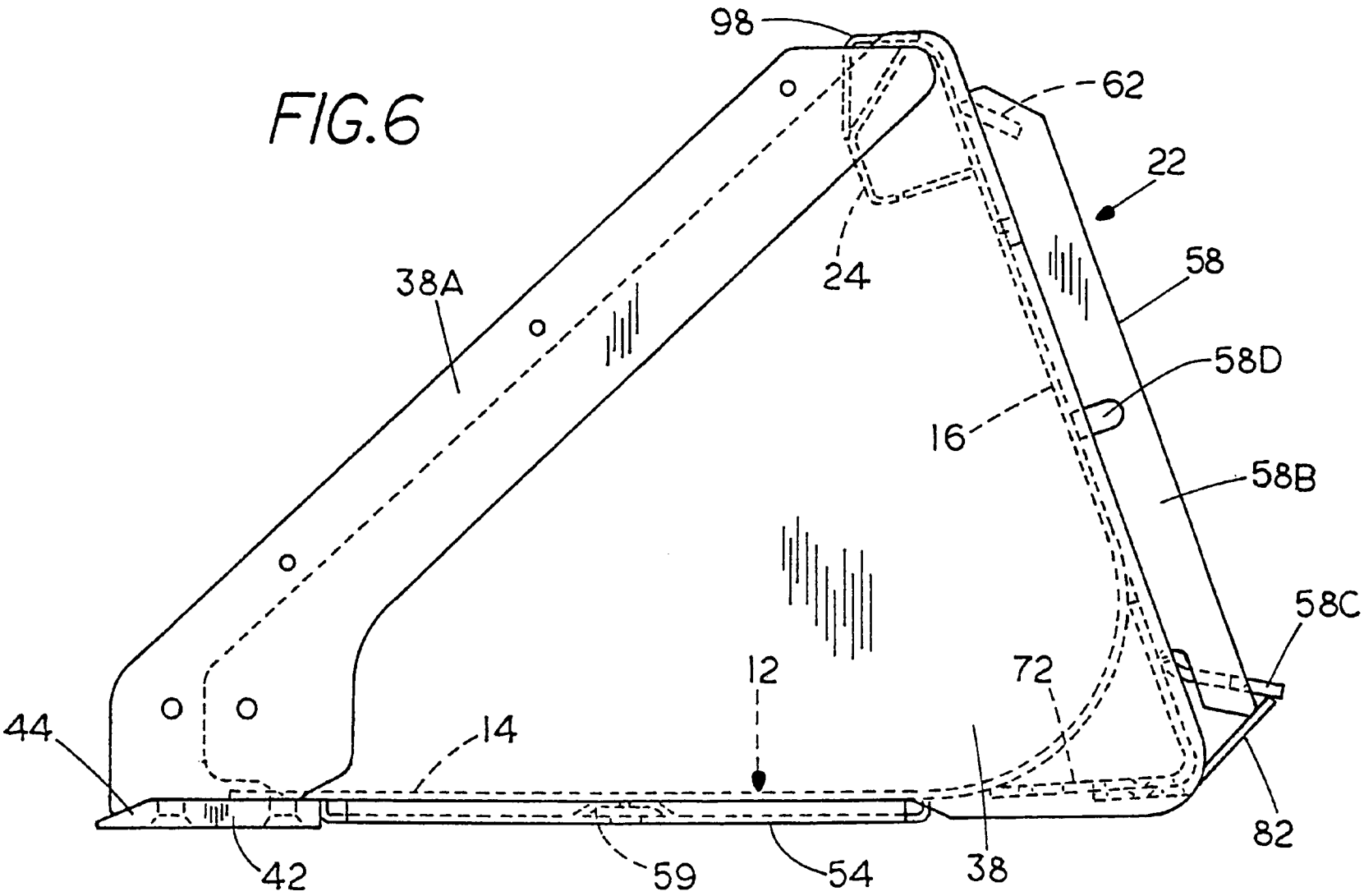
FIG. 6 is a side elevational view of the left side of the bucket of FIG. 1.

Brackets 98 on the top rail are steps that can be used for gaining access to a skid steer loader on which the bucket 10 is mounted. The steps can be added at any time. The front wall 30 of the top rail 24 has a plurality of openings indicated at 100 therein, and these are used for mounting attachments such as a grapple, or the like. In FIG. 4 and in FIG. 6, wrench access openings 102 are shown on the bottom wall 32, so that bolts that are passed through the openings 100 to secure an attachment in place can be tightened. This is conventionally done in formed box sections.

After the parts have been tack welded in place, the final welding can take place with continuous welds along the junction 34, and continuous welds around the wrap around panel 12 where it joins the end plates 38. A continuous weld would be used along the front edge 105 of the bottom wall, to weld the cutter bar securely. The corner reinforcing member 70 also can be welded continuously at the edges of legs 72 and 74, except where leg 74 passes behind the brackets 58 and 60. These welds are accessible, by having the formed top rail that can be welded with one continuous pass along the junction 34, and then providing access for robot held welding heads around the periphery.

The use of gripper holes that are spaced identically on parts that are attached to the wraparound panel 12 insures that the robots will be easily installed on the parts, and the locator tabs shown make it so that the parts that are going to be welded in place are properly positioned by the tabs and then tack welded prior to final welding.

The flanges 58C and 60C are welded securely to the flanges 82 and 84 of the assembly 88.

The exploded view of FIG. 12 shows the individual parts that are assembled together, to make the bucket. Subassemblies are made of the side plates and extensions and the attachment bracket, as stated, the cutter bar is tack welded into position using the slots 50 on the top plate, and the bracket subassembly 22 is put into place on the back wall, the wrap around panel is inverted, and the reinforcing corner 70 and the reinforcing bottom plate 54 are tack welded into place. These two parts use identical robot gripper locator holes. The lower leg 70A also has the locating tabs for holding the attachment flange assembly 88 into position for tack welding in place. Likewise, the tabs 20A, 20B and 20C are used for locating the bracket subassembly 22.

The end plates are welded into position and the bucket is fully assembled except for the steps 98 which are also added at the end.

The formed top rail 24 and locating tabs 20A, 20B and 20C are key to automated manufacture by providing positively located accessible weld junctions for robot welding.

Although the present invention has been described with reference to preferred embodiments, workers skilled in the art will recognize that changes may be made in form and detail without departing from the spirit and scope of the invention.

What is claimed is:

1. A loader bucket having a continuous main bucket panel forming a bottom wall, and a rear wall, with an integral curved junction wall between the bottom wall and the rear wall, and an integrally formed top rail having a rounded corner forming an upper edge of the rear wall, a downwardly sloping, forwardly extending top wall, a front wall joining the forwardly and downwardly sloping top wall and extending substantially parallel to the rear wall, and an integral lower wall substantially perpendicular to the rear wall and extending to the rear wall.

2. The bucket of claim 1, wherein the rear wall has a plurality of partial punch out tabs protruding to an exterior of the rear wall forming locating tabs having edges facing toward the rounded corner, and a mounting bracket subassembly having a pair of uprightly extending brackets, said brackets being spaced apart and held together in the subassembly, each of said brackets having a slot for resting on an edge of a respective locating tab, and a third locating tab engaging an upright edge of one of the brackets.

3. The bucket of claim 2, wherein said brackets have legs bent outwardly therefrom and extending substantially perpendicular to the rear wall and on an exterior side thereof, said legs being along sides of the brackets adjacent respective ends of the bucket.

4. The bucket of claim 2, wherein said brackets have outwardly facing flanges at lower ends thereof, and each of the flanges having a slot for lock pins on an attachment plate used for attaching the bucket to a loader, said slots forming locators for properly spacing the subassembly of the brackets when supported on the locating tabs.

5. The bucket of claim 2 and a reinforcement back brace having a pair of integral legs bent from a corner portion, said reinforcement back brace being mounted to the exterior of the curved junction wall between the bottom wall and the rear wall of the main bucket panel, said integral legs being positioned to be substantially parallel to surfaces of the bottom wall and rear wall, respectively, and supporting lower portions of the brackets.

6. The bucket of claim 1, wherein the top rail lower wall that extends perpendicular to the back wall of the main panel has an edge where it joins the bottom panel accessible from below for robot welding.

7. The bucket of claim 4 and auxiliary brackets mounted onto a lower leg of the reinforcement back brace which is parallel to the bottom wall, the auxiliary brackets having portions extending to be adjacent to the flanges on the brackets for attachment to a loader.

8. The bucket of claim 1 and a wear plate fixed to the bottom wall on an exterior side thereof, said wear plate having a center panel, and upright bent edges at a periphery thereof, and a channel shape formed portion in the center panel that protrudes in the same direction as the bent edges, said channel shaped member and said bent edges engaging the bottom wall and being fixed thereto.

9. The bucket of claim 8, wherein said channel in said wear plate has a plurality of elongated slots for permitting welding to the bottom wall of the bucket main panel.

10. The bucket of claim 9, wherein said wear plate has spaced apart robot gripper openings formed therein.

11. The bucket of claim 5 and planar end plates fixed to ends of said main bucket panel, along junction lines of both the bottom wall and the rear wall, said end plates extending outwardly beyond the curved junction panel of the main bucket panel and supporting end portions of the reinforcement back brace.

12. The bucket of claim 11 and a cutter bar welded on a front edge of the bottom wall, said bottom wall having a series of elongated, generally transversely extending spaced apart slots for providing welding edges to weld the cutter bar into position.

13. A welded construction loader bucket providing accessible edges for welding comprising a continuous main panel forming a bottom wall, a rear wall, and an integrally curved junction wall between the bottom wall and the rear wall, the bottom and rear walls defining a bucket with a forward edge and a top edge, a pair of end walls welded to ends of the main panel, a top rail, integrally formed from the main panel at the top edge of the rear wall, the top rail having a downwardly sloping, forwardly extending rail top wall, a forward rail wall joining the forwardly and downwardly sloping rail top wall and extending substantially parallel to the rear wall, and an integral bottom rail wall substantially perpendicular to the rear wall having an edge welded to such rear wall, the edge of the bottom rail wall providing an edge for welding accessible for a robot welding head.

14. The bucket of claim 13, wherein the rear wall has a plurality of partial punch out locating tabs protruding to an exterior of the rear wall defining locating edges for mounting brackets.

15. The bucket of claim 14 and a wear plate welded to the bottom wall on an exterior side thereof, said wear plate having upright bent peripheral edges, and a channel shaped formed portion in center portions of the plate thereof that protrudes in the same direction as the bent peripheral edges, said channel shaped formed portions and said bent peripheral edges engaging the bottom wall and being fixed thereto.

16. The bucket of claim 15, wherein said channel in said wear plate has a plurality of elongated slots therein for welding to the bottom wall.

* * * * *